United States Patent [19]

Haynes

[11] 4,189,854

[45] Feb. 26, 1980

[54] GRADER BLADE ATTACHMENT

[75] Inventor: John A. Haynes, Sylacauga, Ala.

[73] Assignee: Danek Industries, Inc., Chattanooga, Tenn.

[21] Appl. No.: 925,094

[22] Filed: Jul. 17, 1978

[51] Int. Cl.[2] ..... E02F 3/76

[52] U.S. Cl. ..... 37/117.5; 37/DIG. 3; 414/912; 414/724

[58] Field of Search ..... 37/103, 117.5, 118 R, 37/118 A, DIG. 3, 141 R; 214/131 A, 145 A, DIG. 5

[56] References Cited

U.S. PATENT DOCUMENTS

| | | | |
|---|---|---|---|
| 2,986,826 | 6/1961 | Timmons | 37/117.5 |
| 3,440,744 | 4/1969 | Smith | 37/117.5 |
| 3,469,330 | 9/1969 | Hood et al. | 37/117.5 |
| 3,591,935 | 7/1971 | Bremmer et al. | 37/117.5 |
| 3,658,384 | 4/1972 | Gluszek | 37/117.5 X |
| 3,665,622 | 5/1972 | Lamb | 37/117.5 |
| 3,743,358 | 7/1973 | Guest | 37/117.5 X |
| 3,749,262 | 7/1973 | Stark | 37/117.5 X |
| 3,885,833 | 5/1975 | Lemieux | 37/117.5 X |
| 3,942,271 | 3/1976 | George | 37/117.5 |
| 4,009,529 | 3/1977 | Johnson | 37/117.5 |

*Primary Examiner*—E. H. Eickholt

*Attorney, Agent, or Firm*—Luedeka & Hodges

[57] ABSTRACT

A grader attachment for a bucket, which includes a scoop panel having a cutting edge and a pair of oppositely disposed side panels which define an interior volume, includes a bifurcated frame member, including a first leg and a second leg cooperatively defining an elongated slot therebetween receiving the cutting edge and a substantial portion of the scoop panel of the bucket. The outboard end portion of the first leg is located within the interior volume defined by the bucket. Longitudinally adjustable jackscrews frictionally engage the side panels and laterally adjustable jackscrews frictionally engage the scoop panel. A grader blade is attached to the frame member.

4 Claims, 6 Drawing Figures

GRADER BLADE ATTACHMENT

The present invention relates generally to the field of earth moving equipment and more particularly to grader blades removably attachable to the buckets employed upon front end loaders and backhoes.

Backhoes and front end loaders are essentially tractors which include hydraulically operated elongated buckets. Front end loaders are generally employed to transport dirt, gravel or other material from one location to another. Consequently, the buckets employed are generally quite large, though they vary considerably in size and shape from one model to another. Contrarily, backhoes are employed to dig holes, trenches, etc. Therefore, backhoe buckets are generally significantly smaller than loader buckets, but different models also vary in shape and size.

A grader comprises a tractor from which a generally vertically disposed blade extends downwardly. The blade includes a lower edge which is essentially linear and which is selectively positioned, relative to the tractor. Graders are employed to move materials, by pushing, for the purpose of contouring surfaces, as well as filling trenches, for example. In the case of large construction projects, it is common to employ a first tractor fitted with a backhoe bucket and/or a loader bucket. Frequently, a second tractor is fitted with a pivotally adjustable grader blade. However, for many smaller operations, two separate tractors are not economically justifiable. Therefore attempts have been made to removably attach adjustable grader blades to the bucket of a loader and/or backhoe. Such attachment permits an operator to use a single tractor for both grading and loading.

In the course of contouring dirt or gravel, the pressures applied to a blade vary over a large range. It is important, therefore, that the grader blade is rigidly affixed to the bucket, i.e., that the bucket and grader attachment perform as a single unit during use. A grader blade which wobbles is essentially useless because the resulting surfaces are not consistent and material is not moved efficiently.

Attempts to overcome the rigidity problem which employed detachable blades have not proved adequate. Many prior removable grader attachments attempted to solve the rigidity problem by custom-designing the attachment means to fit a particular bucket having a specific size and shape. In most of the attempts it was necessary to modify the bucket, such as by drilling holes or permanently attaching brackets.

Frequently, however, it is desirable for a single accessory to be adaptable to a wide variety of differently sized and shaped buckets, yet require a minimal amount of equipment and time for mounting and dismounting the accessory. The prior grader accessories which have claimed to be adaptable have required substantial amounts of apparatus and often require modifications to the bucket. The prior grader accessories have also failed to provide pivotal motion of a blade relative to the bucket about two generally perpendicular axes. This flexibility is very desirable in contouring operations.

It is therefore an object of the present invention to provide a grader attachment adaptable to be removably mounted on any of a variety of differently sized and shaped buckets employed upon front end loaders, backhoes or similar equipment. It is another object to provide a removable grader attachment which is relatively simple to install and adjust, yet which is attachable to a variety of buckets in a rigid manner. It is a further object to provide adaptable attaching means for connecting a pivotally adjustable grader to a variety of differently sized and shaped buckets.

Other objects and advantages of the invention will become apparent from the following detailed description, particularly when taken with reference to the drawings in which.

Figure 1:
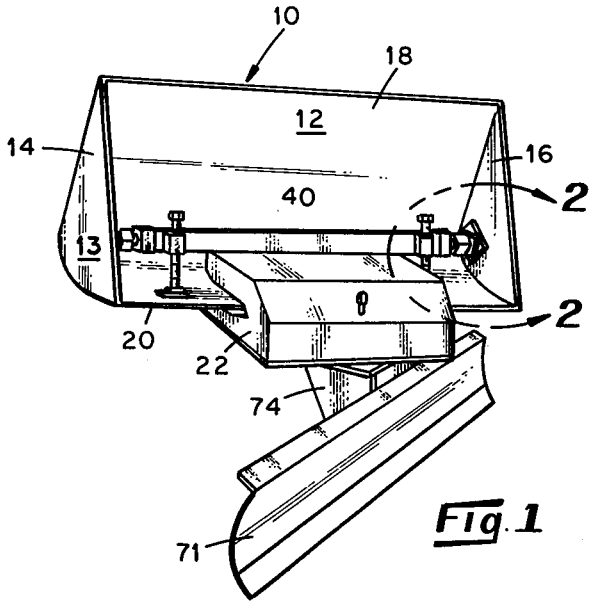
FIG. 1 is a perspective view of a front end loader bucket and an attached grader accessory embodying various of the features of the present invention.
Figure 2:
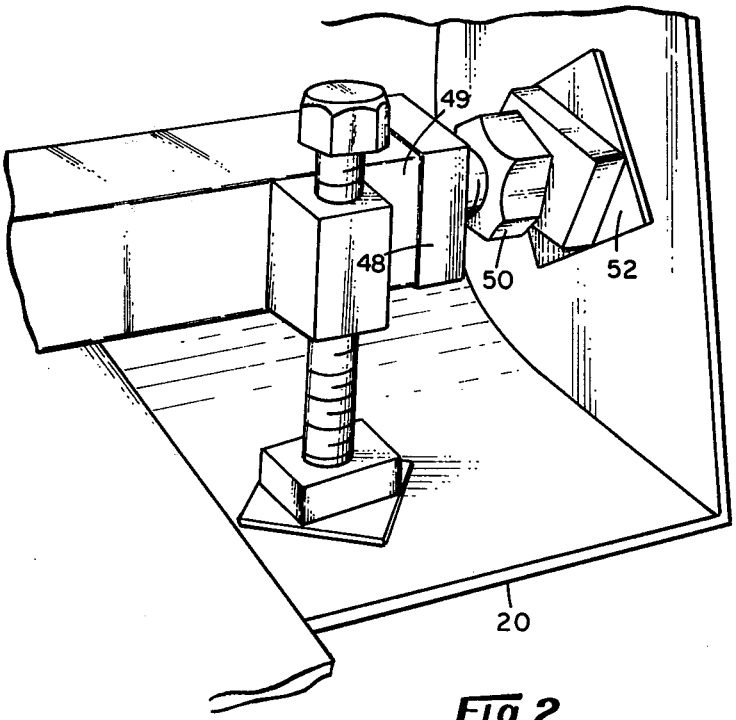
FIG. 2 is an enlarged perspective view of a portion of the grader accessory depicted in FIG. 1.

Generally, the present removable grader accessory is adapted for rigid attachment to a variety of loader or backhoe buckets, each of which includes a scoop panel and generally parallel side panels. The removable grader accessory comprises a depending blade attached to, and extending below, a bifurcated frame member comprising a first leg and a second leg attached to define a slot therebetween which is open on three sides. The slot is adapted to slidably receive a portion of the scoop panel of a bucket with the first leg being inserted into the bucket and overlying the inside surface of the scoop panel, and the second leg being outside the bucket and underlying the outside surface of the scoop panel. Attached to the first leg member which enters the bucket is an elongated rigidifying cross member, the opposite ends of which are provided with longitudinally adjustable means frictionally engaging the bucket side panels, and laterally adjustable means frictionally engaging the bucket scoop panel. When the bucket scoop panel is received within the bifurcated frame member and the engaging means are adjusted to positions of frictional engagement with the bucket, the frame and bucket perform as a single unit.

Referring more particularly to the drawing, a hydraulically operated bucket 10 including an interior surface 12, an exterior surface 13, a pair of generally vertical, parallel, oppositely-disposed side panels 14 and 16 and a scoop panel 18 having a cutting edge 20, defining an interior volume, is pivotally attached by conventional means to a tractor frame. The bucket 10 is preferably fabricated from steel or a similar material and hydraulically operated as is common in commercially available backhoes or front end loaders.

In the depicted accessory there is provided an elongated, bifurcated member 22 which includes a first leg 24 and a second leg 26 spaced apart from one another to define a slot 34 therebetween. The legs 24 and 26 are generally rectangular in shape and receive therebetween and in the slot 34 the cutting edge 20 and a portion of the bucket scoop panel 18. The legs 24 and 26 include inner panels 28 and 30, respectively, which join one another only at the junction line 32. Over a substantial portion of their areas, the panels 28 and 30 are generally parallel and spaced apart a distance greater than the thickness of the bucket scoop panel 18 to define the slot 34 as noted above. The panels 28 and 30 preferably approach one another progressively as it approaches the junction line 32. The length of each of the legs 24 and 26, from their respective outboard ends 36 and 38 to the junction line 32 is substantially greater than the distance between the panels 28 and 30. The width of the frame member legs 24 and 26 is less than the distance between the side panels 14 and 16 of most standard buckets. In a preferred embodiment of a grader accessory for loader buckets, the legs define a slot having a dimension between the panels 28 and 30 of about 7.5 cm, a depth of about 60 cm and a width of about 75 cm. Such a slot is adapted to receive a large portion of each of a variety of bucket scoop panels 18 having different sizes and shapes, thus inserting the outboard end 36 of the first leg 24 into the volume defined by the bucket 10.

Figure 3:
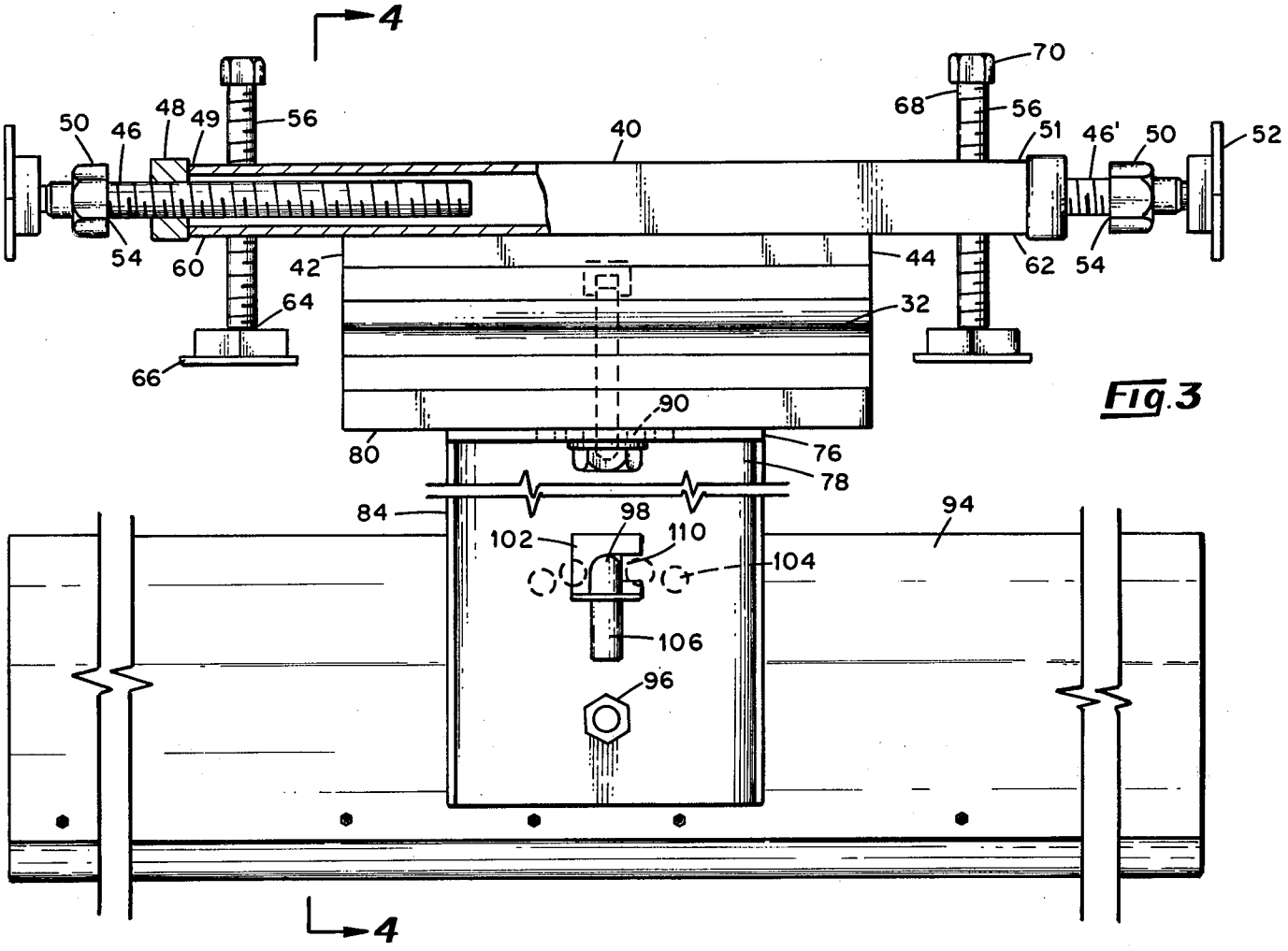
FIG. 3 is a front view of the grader accessory depicted in FIG. 1.
Figure 4:
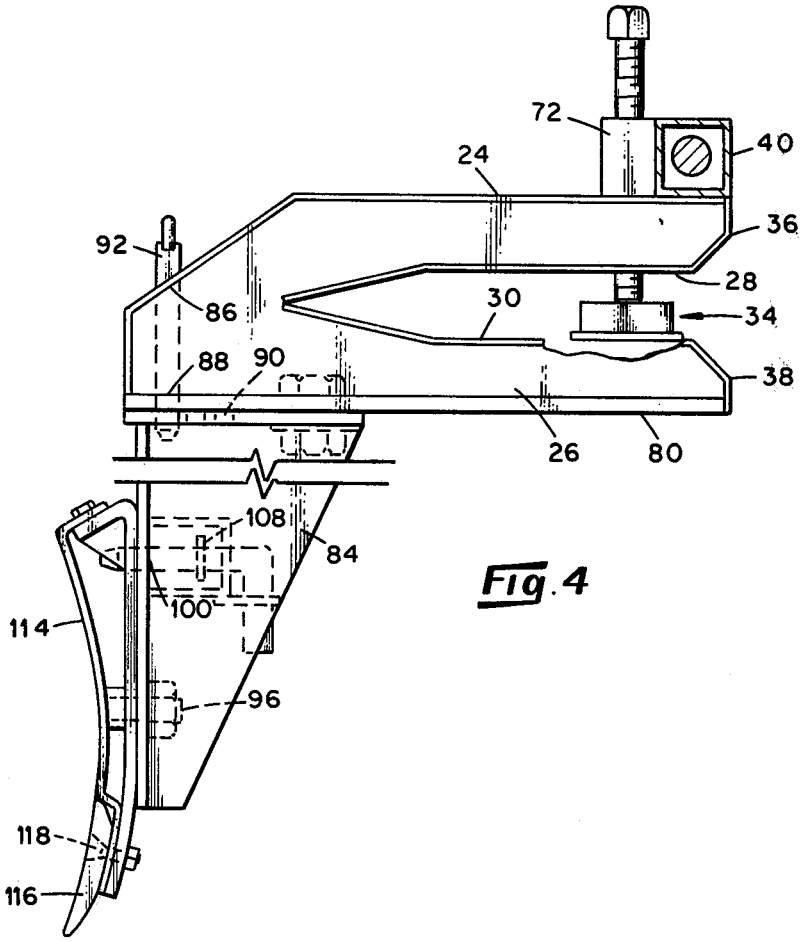
FIG. 4 is a sectional view taken along line 4–4 in FIG. 3.

In the depicted embodiment, an elongated member 40 is attached to the frame member 22, as by welding, along the outboard end 36 of the first leg 24. The cross member 40 preferably has a length greater than the width of the outboard end portion 36, thus extending beyond the side edges 42 and 44 of the first leg 24. A longitudinally extending jackscrew 46 and 46' is adjustably attached to each of the overhanging ends of the cross member 40. In a preferred embodiment, the cross member is hollow and the longitudinal jackscrews 46 and 46' are telescopically received in each end of the cross member 40. As shown in FIG. 3, a nut 48 is fixedly attached to end 49 of the cross member 40, as by welding, and threadably receives the longitudinal jackscrew 46. Each longitudinal jackscrew 46 includes a fixed adjusting nut 50 and an expanded pad 52 at its outboard end 54. The opposite end 51 of the crossmember 40 receives the jackscrew 46' which is of like construction and mounting as the jackscrew 46.

As shown in the Figures, an elongated, adjustable, lateral jackscrew 56 is attached at the overhanging opposite end portions 60 and 62 of the cross member 40. A first end 64 of each radial jackscrew 56 includes an expanded pad 66 and a second end 68 includes an adjusting nut 70 fixedly attached to the radial jackscrew. Each radial jackscrew 56 is threadably received by a nut 72 fixedly attached to the cross member 40, as by welding, and is of a length such that the pad 66 is adjustable between the planes defined by the inner panels 28 and 30 of the legs 24 and 26.

In order to secure the grader blade 71 to the frame 22, there is provided a mounting frame 74, generally L-shaped in cross-section and comprising a first plate 76 oriented generally in a horizontal plane and parallel to the outer panel 80 of the second leg 26 of the frame 22, and a second plate 78 that depends generally perpendicularly from one edge of the first plate 76. This frame 74 is pivotally attached to the outer panel 80 of the second leg 26 as by means of a first pivotal bolt 82 extending through the plate 76 and the outer panel 80 of the leg 26 and defining a first pivotal axis. Gusset plates 84 and 84' are attached to the first plate 76 and second plate 78 for reinforcement thereof. A pair of first coaxial apertures 86 and 88 are defined in the frame member 22 and a plurality of first locking apertures 90 are defined in the first plate 76. Pivotal motion of the mounting frame about the first pivotal axis defined by the bolt 82 successively places each of the first locking apertures 90 in coaxial alignment with the apertures 86 and 88. A first lock pin 92 is slidably received by the apertures 86, 88, and 90 to selectively prohibit pivotal motion about the first pivotal axis.

The blade 71 is pivotally secured to the second plate 78 by means of generally planar blade plate 94 that is pivotally attached to the mounting frame 74 in a position generally parallel to the second plate 78 as by means of a second pivotal bolt 96, defining a blade pivotal axis that is oriented generally horizontally and parallel to the second inner panel 30. A pair of second coaxial apertures 98 and 100 are defined in the mounting plate 78. The aperture 100 is defined within the second plate 78 and the aperture 98 is defined by a bracket 102 rigidly attached to the mounting frame 74, as by welding. A plurality of second locking apertures 104 are defined in the blade frame 94. Pivotal motion of the blade frame about the second pivotal axis successively places each of the second locking apertures 104 in coaxial alignment with the second coaxial apertures 98 and 100. A second lock pin 106 is slidably received by the apertures 98, 100, and 104 to selectively prohibit pivotal motion about the second pivotal axis. Stop means 108 is attached to the second lock pin 106 to prevent total withdrawal of the second lock pin from the bracket 102 and a slot 110 is provided in the bracket 102 to further inhibit unintentional withdrawal of the pin 106.

The grader blade 71, comprising a permanent portion 114 and a replaceable, wearing portion 116 is attached to the blade frame 94 by means of bolts 118.

In operation, the cutting edge 20 of a bucket 10 is inserted into the slot 34, defined between legs 24 and 26, to a position of maximum insertion preferably adjacent the junction line 32. As noted above, the slot 34 is tapered toward the junction line 32. Buckets including tapered cutting edges or tapered cutting teeth engage a mating surface thereby and thus increase rigidity. In this position, the cross member 40 is contained within the volume defined by the bucket side panels 14 and 16 and scoop panel 18. The longitudinal jackscrews 46 and 46' are extended longitudinally from the cross member until the pads 52 securely engage the side panels 14 and 16 of the bucket 10. The lateral jackscrews 56 are extended laterally from the cross member until the pads 66 securely engage the scoop panel 18, preferably at a location proximate to the cutting edge 20, to rotate the legs 24 and 26 toward a position where the outboard end 36 of the leg 24 is biased away from the scoop panel 18 and the outboard end 38 of the leg is biased toward the scoop panel 18, thereby preventing subsequent pivotal motion of the frame member 22 relative to the bucket 10. At this point the scoop panel 18 engages the inner panels 28 and 30 along at least two lines. All four jackscrews are then tightened, as with a wrench, to insure tight frictional engagement of the pads 52 and 66 with the bucket interior surface 12. The frame member 22 is thus rigidly attached to the bucket 10.

The first lock pin 92 is slidably withdrawn from a first locking aperture 90, and the mounting frame 74 is pivoted to the desired position relative to the bucket 10 and the associated tractor. The first lock pin 92 is reinserted into the first locking aperture 90 axially aligned with the apertures 86 and 88, thus fixing the position of the mounting frame 74 relative to the frame member 22 and the bucket 10.

The second lock pin 106 is slidably withdrawn from a second locking aperture 104 and the blade frame 94 is pivoted to the desired position relative to the bucket 10 and the associated tractor. The second lock pin 106 is reinserted into the second locking aperture 104 axially aligned with the openings 98 and 100, thus fixing the position of the blade frame 94 and the attached blade 112 relative to the mounting frame 74.

Figure 5:
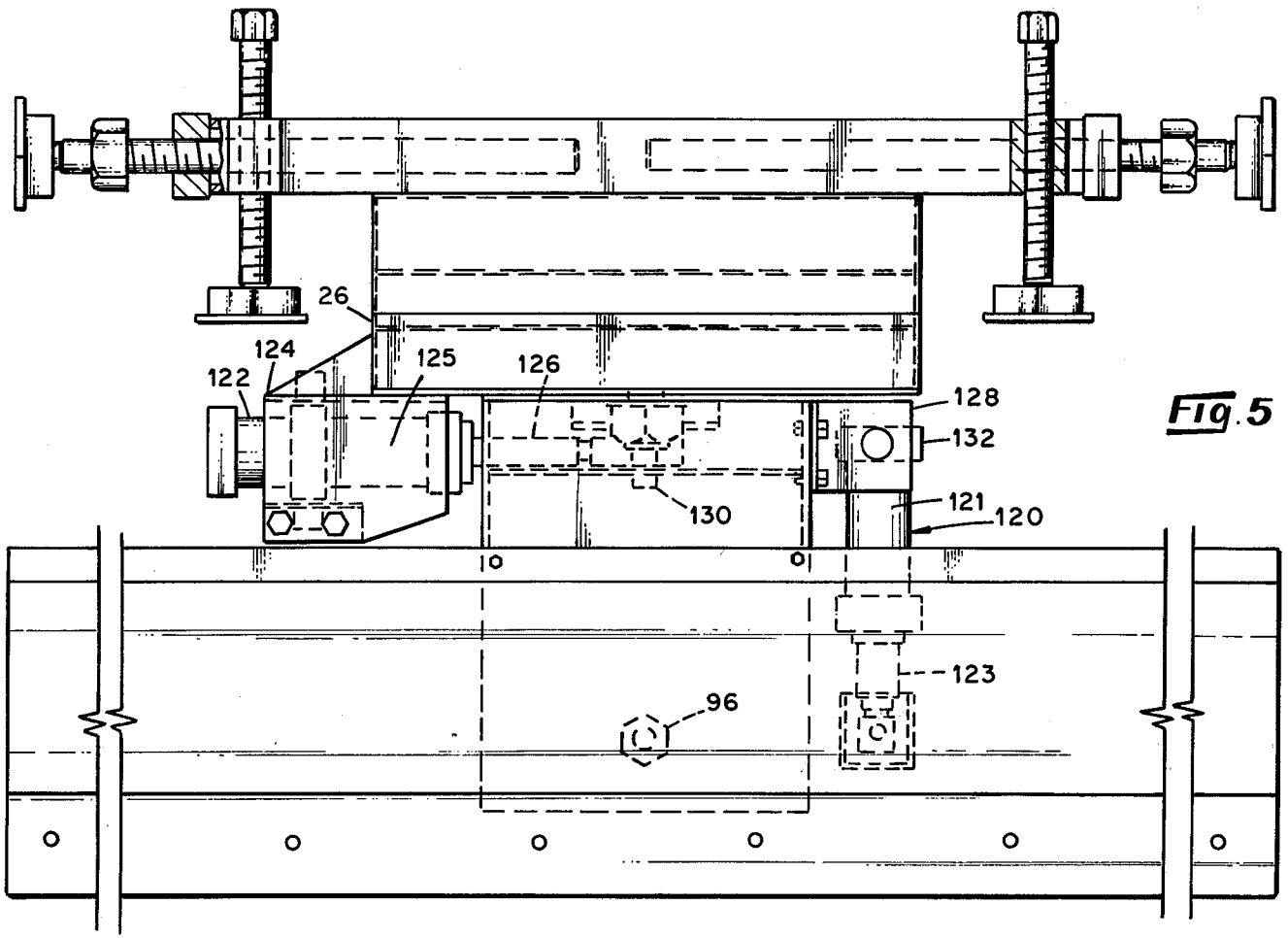
FIG. 5 is a front view of a hydraulically powered grader accessory embodying various of the features of the present invention.
Figure 6:
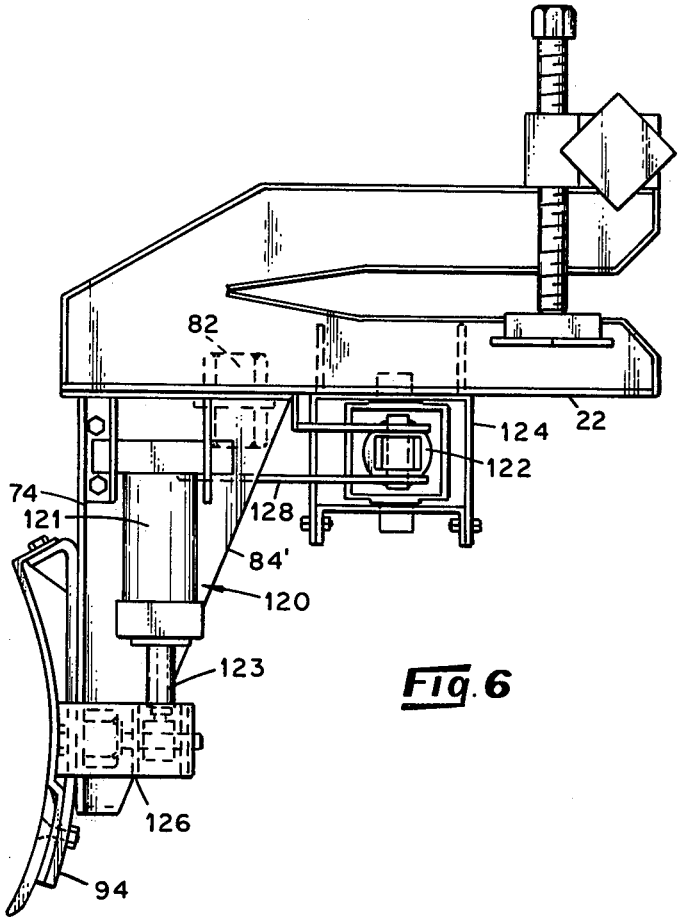
FIG. 6 is a left side view of the grader accessory shown in FIG. 5.

In the embodiment shown in FIGS. 5 and 6, pivotal motion of the blade frame 94 relative to the mounting frame 74 and pivotal motion of the mounting frame 74 relative to the frame member 22 are controlled by means of an extendable hydraulic blade piston-cylinder 120 and a frame piston-cyclinder 122, respectively. The cylinder 121 of the piston-cylinder 120 is fixedly mounted by a bracket 128 to the gusset plate 84 with the outboard end of the piston 123 being connected to the blade frame 74. Accordingly, extension or retraction of the piston 123 urges the blade 71 to pivot about the axis of the second pivotal bolt 96 to selectively pivot the blade to a desired angle relative to the horizontal. The cylinder 125 of the frame piston-cylinder 122 is fixedly attached by a bracket 124 to the outer panel 80 of the second leg 26 of the frame member 22. The outboard end of the piston 126 of the frame cylinder 122 is pivotally attached by a bracket 128 to the mounting frame 74 to pivot about the axis of the first pivotal bolt 82 thereby selectively positioning the blade at a desired angle relative to the lateral dimension of the bucket 10.

A grader accessory in accordance with the foregoing description provides a grader blade which is removable, yet rigidly attachable to the bucket of a loader or backhoe. The bucket and attachment form a unitary body in any of a variety of relative pivotal positions. The attachment comprises a minimal amount of apparatus and is easily installed by a single operator. There are no required modifications to the bucket, such as drilling holes or attaching brackets. Nor are there loose parts, such as nuts and bolts, which are easily lost when the grader accessory is not in use. Furthermore, the grader attachment is adjustable to adapt to a wide variety of sizes and shapes of buckets.

More specifically, it is noted that in a grading operation rotational forces on the bucket which are greatest tend to rotate the blade about a horizontal axis associated with the mounting means used to attach the blade to the bucket. The present device functions in two ways to accommodate such rotational tendency. First, the legs of the bifurcated frace each bear against the scoop panel over a substantial distance to develop a substantial mechanical advantage opposing rotation of the blade about a horizontal axis passing through the general location of the mounting means. Second, the design of the cross member and its laterally extending jackscrews is chosen to position the outboard end 36 of the first leg 24 of the bifucated frame out of contact with the upper surface of the scoop panel and simultaneously to position the outboard end 38 of the second leg 26 of the bifurcated frame toward frictional engagement with the outer surface 13 of the scoop panel 18. In this manner, the bifurcated frame is biased toward that rotational position relative to the bucket which the blade accessory, as a whole, will seek when in use. The mounting means thus accommodates those anticipated forces which tend to dislodge the accessory, rather than oppose such forces. This permits the present device to maintain blade rigidity with relatively simple and inexpensive means. Further, the design provides for easy and rapid mounting and demounting of the accessory.

Whereas there has been described an specific embodiment of the present grader attachment, it is to be recognized that one skilled in the art could make modifications and/or changes and the scope of the invention is intended to be limited only as set forth in the appended claims.

What is claimed:

1. A grader attachment for a bucket, including a scoop panel having a cutting edge and a pair of oppositely disposed side panels and defining an interior volume, said attachment comprising a bifurcated frame member including a first leg and a second leg cooperatively defining an elongated slot therebetween receiving the cutting edge and a substantial portion of the scoop panel of the bucket to locate an outboard end portion of the first leg within the interior volume defined by the bucket, longitudinally adjustable means for frictionally engaging said side panels, laterally adjustable means frictionally engaging the scoop panel, and a grader blade attached to said frame member.

2. A grader attachment as defined in claim 1 wherein said longitudinal engaging means comprises a pair of coaxial, oppositely directed jackscrews, each of said longitudinal jackscrews being threadably attached to said first leg outboard end portion and extending toward one of said side walls.

3. A grader attachment as defined in claim 1 wherein said lateral engaging means comprises a pair of generally parallel jackscrews threadably connected to said first leg and extending toward said scoop panel.

4. A grader attachment as defined in claim 1 including means attaching the grader to the frame member comprising a mounting frame pivotally attached to the frame member and a blade frame pivotally attached to said mounting frame, the grader blade being attached to the blade frame.

* * * * *